US009687117B1

(12) United States Patent
Koch

(10) Patent No.: US 9,687,117 B1
(45) Date of Patent: Jun. 27, 2017

(54) MEDICINE CABINET ORGANIZER DEVICE

(71) Applicant: Jim Koch, Jerome, ID (US)

(72) Inventor: Jim Koch, Jerome, ID (US)

( * ) Notice: Subject to any disclaimer, the term of this patent is extended or adjusted under 35 U.S.C. 154(b) by 0 days.

(21) Appl. No.: 15/152,557

(22) Filed: May 12, 2016

(51) Int. Cl.
*A47K 1/09* (2006.01)
*A47K 5/18* (2006.01)
*A47B 67/02* (2006.01)

(52) U.S. Cl.
CPC ..... *A47K 1/09* (2013.01); *A47B 67/02* (2013.01); *A47K 5/18* (2013.01)

(58) Field of Classification Search
CPC ... A47K 1/09; A47K 1/08; A47K 5/18; A45D 27/22; A45D 44/18; A47B 81/005; A47B 67/02; Y10T 403/315; Y10T 403/32041
USPC ..... 211/65, 87.01, 70.1, 119.009, 66, 60.1; 248/110, 108; D6/528, 531, 534; 206/362.1, 362, 581, 361; 132/310; 312/207, 206
See application file for complete search history.

(56) References Cited

U.S. PATENT DOCUMENTS 1,291,349 A * 1/1919 Ackers ..... A47K 1/09 211/65
2,028,694 A * 1/1936 Spinks ..... A47K 1/09 211/65
2,564,353 A * 8/1951 Coleman ..... A47K 1/09 312/206
2,623,642 A * 12/1952 Looney ..... A47F 7/0028 211/65
D176,162 S * 11/1955 Steece ..... 211/65
2,894,639 A * 7/1959 Caporicci ..... A47K 1/09 108/28
2,904,188 A * 9/1959 Richardson ..... A47L 13/512 211/65
2,917,182 A * 12/1959 Browne ..... A47K 1/09 211/65
3,194,621 A * 7/1965 Frost ..... A47K 1/09 312/206
D219,599 S * 12/1970 Rams et al. ..... D6/528
4,583,647 A * 4/1986 Schinzing ..... A47B 81/007 211/60.1
D297,692 S 9/1988 Martinez
4,795,121 A * 1/1989 Comito ..... F21S 4/10 211/26
5,499,725 A * 3/1996 Palumbo ..... A47K 3/001 211/105.1
5,609,259 A * 3/1997 Menard ..... A47K 1/09 211/66
5,769,245 A 6/1998 Butler
(Continued)

*Primary Examiner* — Daniel J Troy
*Assistant Examiner* — Hiwot Tefera

(57) ABSTRACT

A medicine cabinet organizer device includes a housing that is substantially rectangularly box shaped. The housing has a front, which is open. Slits and slots are positioned in a top of the housing. The slits and slots extend from a front edge to proximate to a back edge of the top. Fasteners are coupled to a back of the housing and are configured to couple the housing to a medicine cabinet. Pegs are positioned on opposing sides of the housing and are configured for the user to hang items. Each slit is configured for insertion of a bottom end of a tube such that the tube is retained in a cap down position substantially within the housing. Each slot is configured for insertion of a handle of a toothbrush such that a head of the toothbrush is positioned above the top of the housing.

18 Claims, 4 Drawing Sheets

(56) References Cited

U.S. PATENT DOCUMENTS

| | | | | |
|---|---|---|---|---|
| D419,018 | S | 1/2000 | Jeynes | |
| 6,253,931 | B1 * | 7/2001 | Starkey | A47K 1/09 211/65 |
| 6,402,104 | B1 * | 6/2002 | Smith | A47K 1/09 248/205.5 |
| D478,756 | S | 8/2003 | Hood | |
| 7,721,899 | B2 * | 5/2010 | Lambert | A47K 1/09 211/119.009 |
| D676,695 | S | 2/2013 | Dinh | |
| 2003/0089673 | A1 * | 5/2003 | Herren | A47K 1/09 211/66 |
| 2005/0035072 | A1 | 2/2005 | Tayebi | |
| 2005/0109662 | A1 * | 5/2005 | Kirk | A47K 1/09 206/581 |
| 2008/0087785 | A1 * | 4/2008 | Roche | A47B 81/005 248/309.4 |
| 2008/0121596 | A1 | 5/2008 | Adkins | |

* cited by examiner

MEDICINE CABINET ORGANIZER DEVICE

BACKGROUND OF THE DISCLOSURE

Field of the Disclosure

The disclosure relates to organizer devices and more particularly pertains to a new organizer device for organizing a medicine cabinet.

SUMMARY OF THE DISCLOSURE

An embodiment of the disclosure meets the needs presented above by generally comprising a housing that is substantially rectangularly box shaped. The housing has a front, which is open. Slits and slots are positioned in a top of the housing. The slits and slots extend from a front edge to proximate to a back edge of the top. Fasteners are coupled to a back of the housing and are configured to couple the housing to a medicine cabinet. Pegs are positioned on opposing sides of the housing and are configured for the user to hang items. Each slit is configured for insertion of a bottom end of a tube such that the tube is retained in a cap down position substantially within the housing. Each slot is configured for insertion of a handle of a toothbrush such that a head of the toothbrush is positioned above the top of the housing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
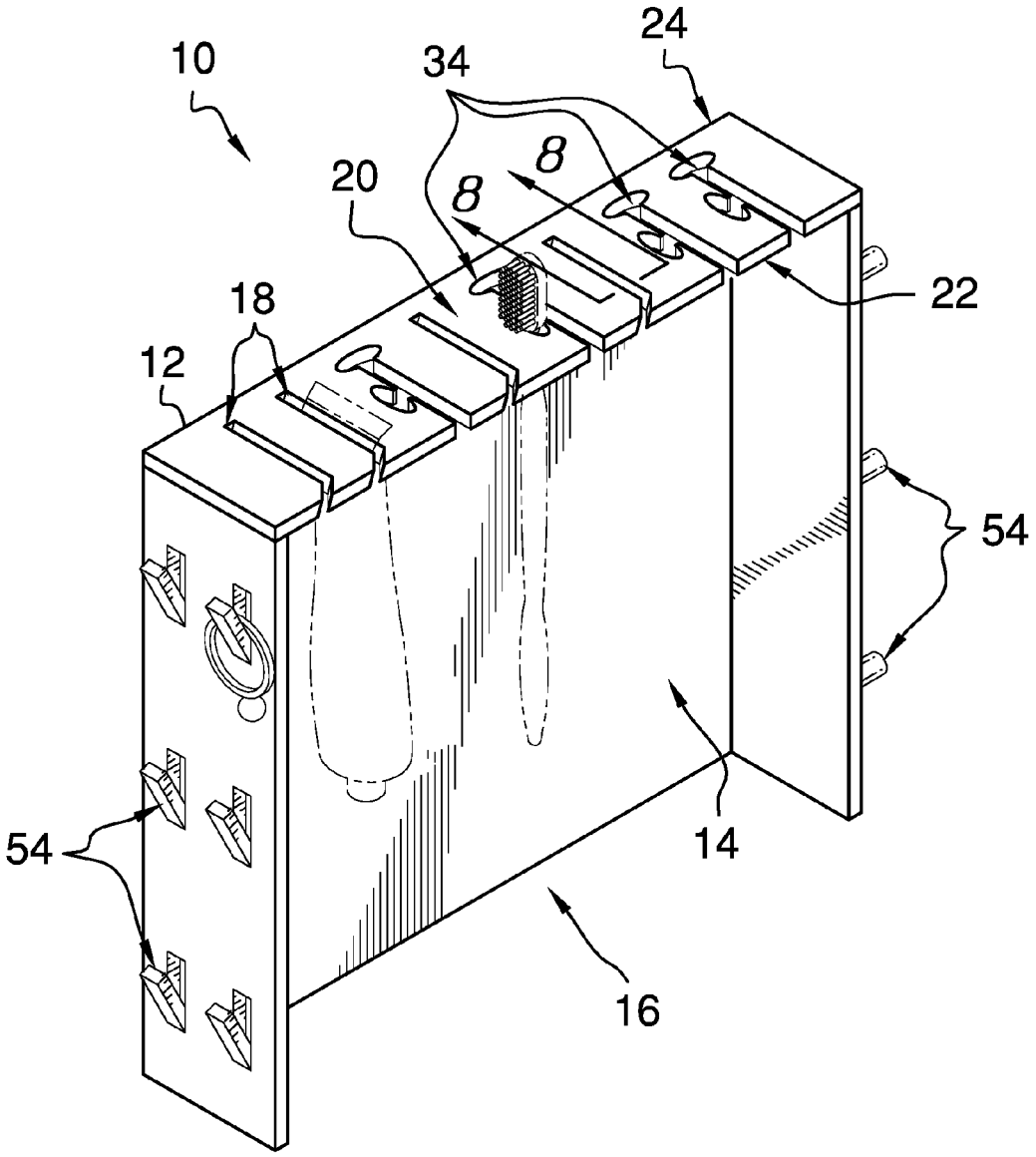
FIG. 1 is an isometric perspective view of a medicine cabinet organizer device according to an embodiment of the disclosure.
Figure 2:
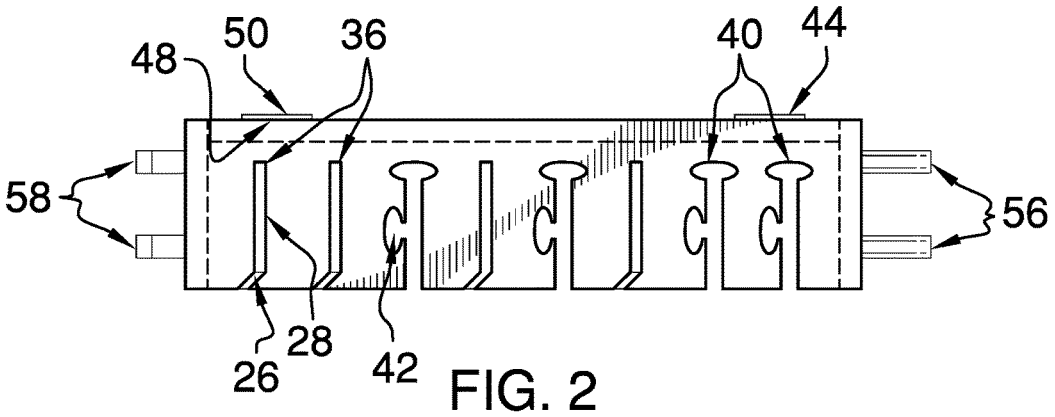
FIG. 2 is a top view of an embodiment of the disclosure.
Figure 3:
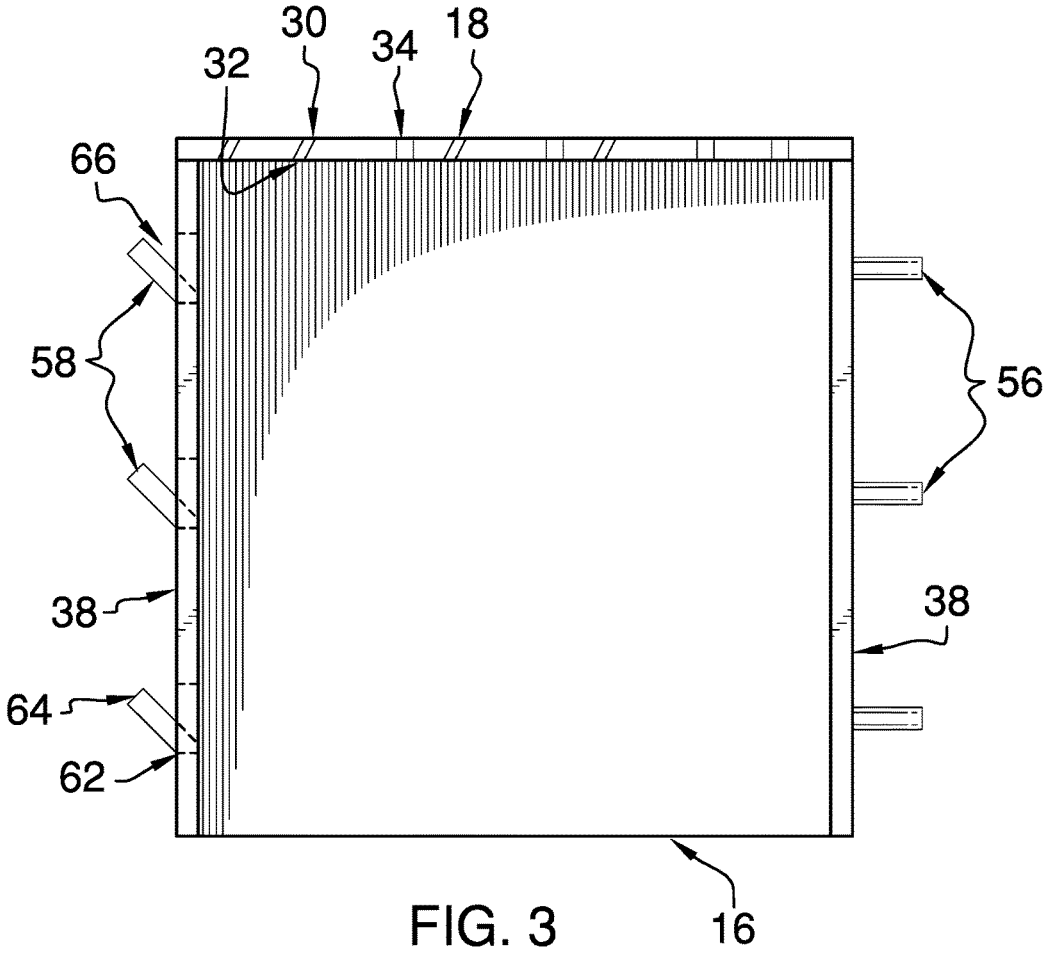
FIG. 3 is a front view of an embodiment of the disclosure.
Figure 4:
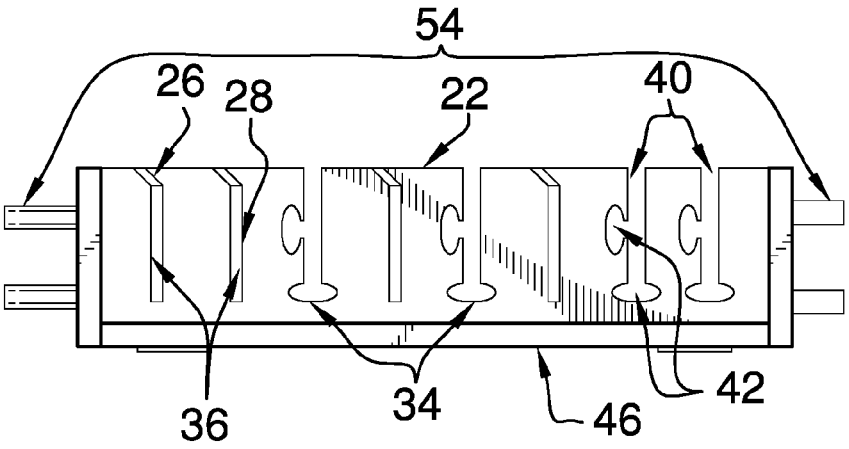
FIG. 4 is a bottom view of an embodiment of the disclosure.
Figure 5:
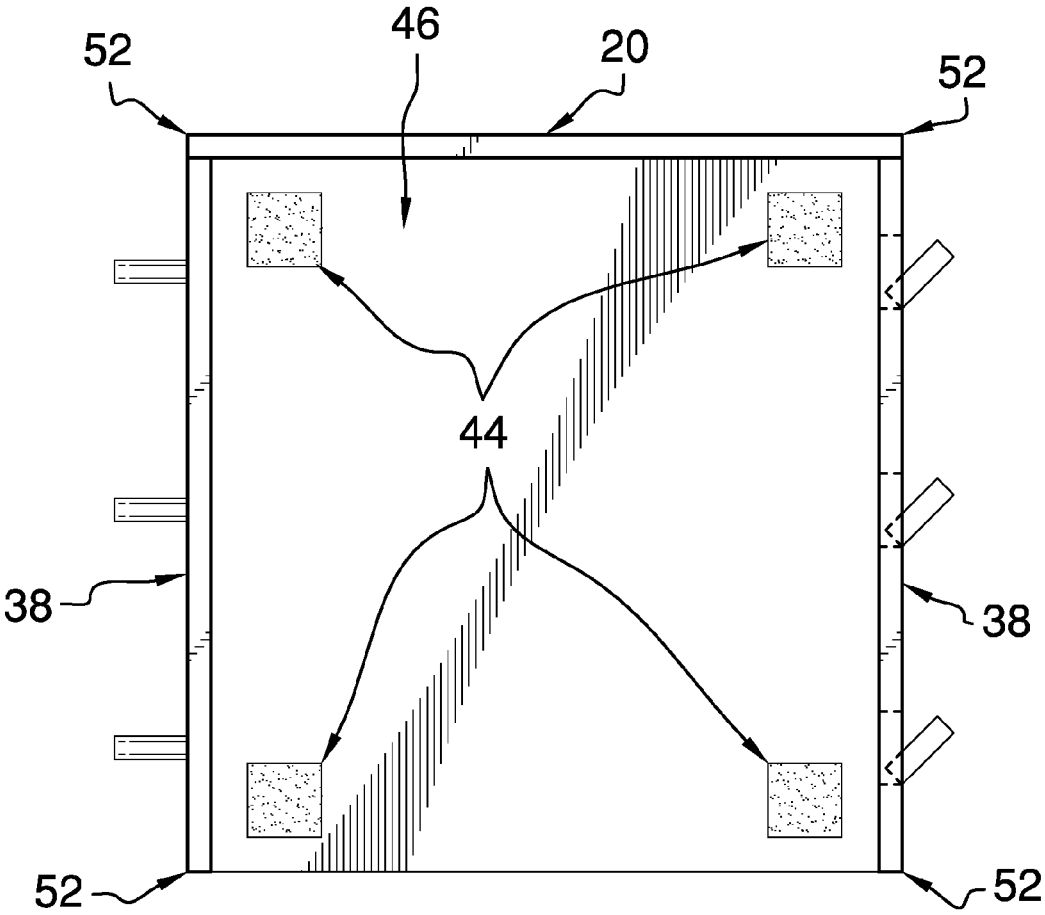
FIG. 5 is a back view of an embodiment of the disclosure.
Figure 6:
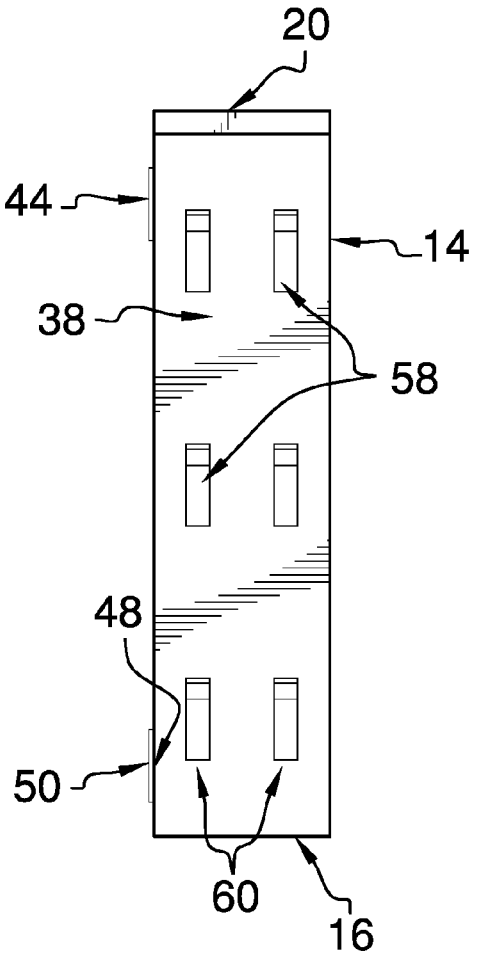
FIG. 6 is a side view of an embodiment of the disclosure.
Figure 7:
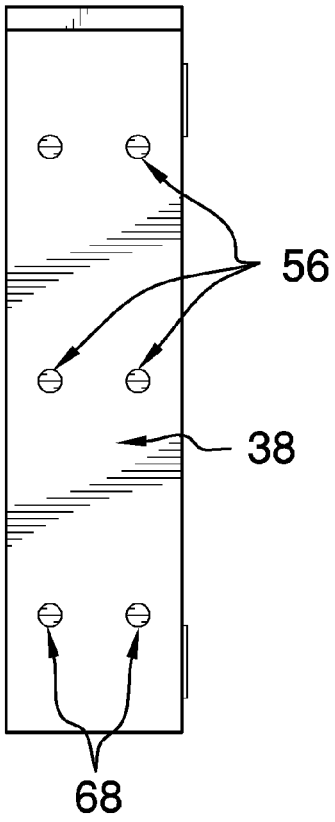
FIG. 7 is a side view of an embodiment of the disclosure.
Figure 8:
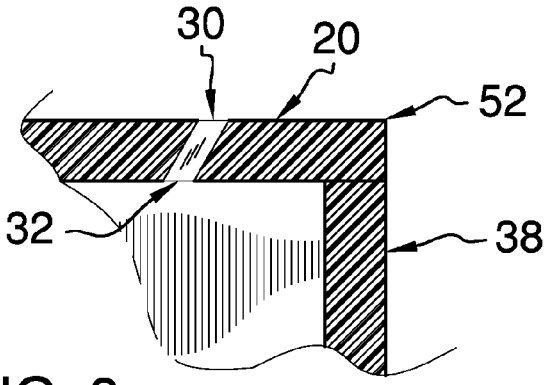
FIG. 8 is a cross-sectional view of an embodiment of the disclosure.

With reference now to the drawings, and in particular to FIGS. 1 through 8 thereof, a new organizer device embodying the principles and concepts of an embodiment of the disclosure and generally designated by the reference numeral 10 will be described.

As best illustrated in FIGS. 1 through 8, the medicine cabinet organizer device 10 generally comprises a housing 12 that is substantially rectangularly box shaped. The housing 12 has a front 14 and a bottom 16, which are open.

Each of a plurality of slits 18 is positioned in a top 20 of the housing 12. The slits 18 extend from a front edge 22 of the top 20 to proximate to a back edge 24 of the top 20. Each slit 18 is configured for insertion of a bottom end of a tube, such that the tube is retained in a cap down position substantially within the housing 12. In one embodiment, each slit 18 comprises a first section 26 that extends angularly from the front edge 22 of the top 20 to a second section 28 of the slit 18. The second section 28 extends from the first section 26 toward the back edge 24 of the top 20. The second section 28 is substantially perpendicular to the front edge 22. The first section 26 and the second section 28 of the slit 18 extend angularly through the top 20, such that an upper limit 30 of the slit 18 is offset from a lower limit 32 of the slit 18. The plurality of slits 18 comprises from two to six the slits 18. In another embodiment, the plurality of slits 18 comprises four slits 18.

Each of a plurality of slots 34 is positioned in the top 20 of the housing 12. The slots 34 extend from the front edge 22 of the top 20 to proximate to the back edge 24 of the top 20. Each slot 34 is configured for insertion of a handle of a toothbrush, such that a head of the toothbrush is positioned above the top 20 of the housing 12. The plurality of slots 34 comprises from two to six slots 34. In another embodiment, the plurality of slots 34 comprises four slots 34.

Each of the slits 18 and each of the slots 34 are substantially evenly spaced in the top 20. The plurality of slits 18 and the plurality of slots 34 are positioned in the top 20 such that a pair 36 of the slits 18 is positioned adjacent to one opposing side 38 of the housing 12 and a duo 40 of the slots 34 is positioned adjacent to the other opposing side 38. Two slots 34 and two slits 18 are alternately positioned between the pair 36 of slits 18 and the duo 40 of slots 34.

Each slot 34 comprises a plurality of cutouts 42. The cutouts 42 are positioned through the top 20 and extend from the slot 34. Each cutout 42 is configured for insertion of a toothbrush handle. In one embodiment, the cutouts 42 are substantially ovally shaped. Each of the pluralities of cutouts 42 comprises two cutouts 42, such that each slot 34 is configured for insertion of two toothbrush handles.

Each of a plurality of fasteners 44 is coupled to a back 46 of the housing 12. In one embodiment, the fasteners 44 comprise double-sided tape. A first side 48 of the fastener 44 is coupled to the back 46 of the housing 12 and a second side 50 of the fastener 44 is configured to couple to the medicine cabinet. The plurality of fasteners 44 comprises fasteners 44 positioned proximate to each corner 52 of the back 46 of the housing 12.

Each of a plurality of pegs 54 is positioned on and coupled to a respective opposing side 38 of the housing 12. The plurality of pegs 54 comprises a plurality of dowels 56 and a plurality of couplers 58. Each dowel 56 is coupled to and extends substantially perpendicularly from a respective opposing side 38 of the housing 12. The dowels 56 are substantially circular when viewed perpendicularly from the respective opposing side 38. The plurality of dowels 56 comprises six dowels 56 positioned in two rows 60. The rows 60 extend from proximate to the top 20 to proximate to the bottom 16.

Each coupler 58 is coupled to and extends transversely from a respective opposing side 38 of the housing 12. The couplers 58 are substantially rectangularly box shaped when viewed longitudinally. Each coupler 58 is coupled by a first end 62 to the respective opposing side 38. The coupler 58 has a second end 64 that is positioned above the first end 62, defining a catch 66 that comprises the coupler 58 and the housing 12. The plurality of couplers 58 comprises six couplers 58 positioned in two lines 68. The lines 68 extend from proximate to the top 20 to proximate to the bottom 16.

In use, the fasteners 44 positioned on the back 46 of the housing 12 are configured to couple the housing 12 to a medicine cabinet. Each slit 18 is configured for insertion of a bottom 16 end of a tube. The tube is retained in a cap down position substantially within the housing 12. Each slot 34 is configured for insertion of a toothbrush handle such that the toothbrush head is positioned above the top 20 of the housing 12. The pegs 54 are positioned on the opposing sides 38 of the housing 12 such that the pegs 54 are configured for the user to hang items on the pegs 54.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A medicine cabinet organizer device comprising:

a housing, said housing being substantially rectangularly box shaped, said housing having a front, said front being open;

a plurality of slits positioned in a top of said housing, said slits extending from a front edge of said top to proximate to a back edge of said top, wherein each said slit is configured for insertion of a bottom end of a tube such that the tube is retained in a cap down position substantially within said housing, each said slit comprising a first section extending angularly from said front edge of said top to a second section of said slit, said second section extending from said first section toward said back edge of said top, such that said second section is substantially perpendicular to said front edge, said first section and said second section of said slit extending angularly through said top, such that an upper limit of said slit is offset from a lower limit of said slit;

a plurality of slots positioned in said top of said housing, said slots extending from said front edge of said top to proximate to said back edge of said top, wherein each said slot is configured for insertion of a handle of a toothbrush such that a head of the toothbrush is positioned above said top of said housing;

a plurality of fasteners coupled to a back of said housing;

a plurality of pegs, each said peg being positioned on and coupled to a respective opposing side of said housing; and wherein said fasteners are positioned on said back of said housing such that said fasteners are configured to couple said housing to a medicine cabinet, wherein each said slit is configured for insertion of a bottom end of a tube such that the tube is retained in a cap down position substantially within said housing, wherein each said slot is configured for insertion of a toothbrush handle such that the toothbrush head is positioned above said top of said housing, and wherein said pegs are positioned on said opposing sides of said housing such that said pegs are configured for the user to hang items on said pegs.

2. The device of claim 1, further including said housing having a bottom, said bottom being open.

3. The device of claim 1, further comprising:

said plurality of slits comprising from two to six said slits; and said plurality of slots comprising from two to six said slots.

4. The device of claim 3, further comprising:

said plurality of slits comprising four said slits; and said plurality of slots comprising four said slots.

5. The device of claim 4, further including each of said slits and said slots being substantially evenly spaced in said top.

6. The device of claim 5, further including said plurality of slits and said plurality of slots being positioned in said top such that a pair of said slits are positioned adjacent to one said opposing side, a duo of said slots are positioned adjacent to the other said opposing side, and wherein two said slots and two said slits are alternately positioned between said pair of said slits and said duo of said slots.

7. The device of claim 1, further including each said slot comprising a plurality of cutouts, said cutouts being positioned through said top and extending from said slot, wherein each said cutout extends from said slot such that said cutout is configured for insertion of a toothbrush handle.

8. The device of claim 7, further including said cutouts being substantially ovally shaped.

9. The device of claim 7, further including each of said pluralities of cutouts comprising two cutouts, wherein each said slot is configured for insertion of two toothbrush handles.

10. The device of claim 1, further including said fasteners comprising double-sided tape, wherein a first side of said fastener is coupled to said back of said housing and a second side of said fastener is configured to couple to the medicine cabinet.

11. The device of claim 10, further including said plurality of fasteners comprising fasteners positioned proximate to each corner of said back of said housing.

12. The device of claim 1, further including said plurality of pegs comprising:

a plurality of dowels coupled to and extending substantially perpendicularly from a respective opposing side of said housing; and a plurality of couplers coupled to and extending transversely from a respective opposing side of said housing.

13. The device of claim 12, further including said dowels being substantially circular when viewed perpendicularly from said respective said opposing side.

14. The device of claim 12, further including said plurality of dowels comprising six said dowels positioned in two rows, said rows extending from proximate to said top to proximate to said bottom.

15. The device of claim 12, further including said couplers being substantially rectangularly box shaped when viewed longitudinally.

16. The device of claim 12, further including said plurality of couplers comprising six said couplers positioned in two lines, said lines extending from proximate to said top to proximate to said bottom.

17. A medicine cabinet organizer device comprising:

a housing, said housing being substantially rectangularly box shaped, said housing having a front, said front being open;

a plurality of slits positioned in a top of said housing, said slits extending from a front edge of said top to proximate to a back edge of said top, wherein each said slit is configured for insertion of a bottom end of a tube such that the tube is retained in a cap down position substantially within said housing;

a plurality of slots positioned in said top of said housing, said slots extending from said front edge of said top to proximate to said back edge of said top, wherein each said slot is configured for insertion of a handle of a toothbrush such that a head of the toothbrush is positioned above said top of said housing;

a plurality of fasteners coupled to a back of said housing;

a plurality of pegs, each said peg being positioned on and coupled to a respective opposing side of said housing, said plurality of pegs comprising a plurality of dowels coupled to and extending substantially perpendicularly from a respective opposing side of said housing, and a plurality of couplers coupled to and extending transversely from a respective opposing side of said housing;

wherein said fasteners are positioned on said back of said housing such that said fasteners are configured to couple said housing to a medicine cabinet, wherein each said slit is configured for insertion of a bottom end of a tube such that the tube is retained in a cap down position substantially within said housing, wherein each said slot is configured for insertion of a toothbrush handle such that the toothbrush head is positioned above said top of said housing, and wherein said pegs are positioned on said opposing sides of said housing such that said pegs are configured for the user to hang items on said pegs; and each said coupler being coupled by a first end to said respective said opposing side, said coupler having a second end positioned above said first end defining a catch comprising said coupler and said housing.

18. A medicine cabinet organizer device comprising:

a housing, said housing being substantially rectangularly box shaped, said housing having a front, said front being open, said housing having a bottom, said bottom being open;

a plurality of slits positioned in a top of said housing, said slits extending from a front edge of said top to proximate to a back edge of said top, wherein each said slit is configured for insertion of a bottom end of a tube such that the tube is retained in a cap down position substantially within said housing, each said slit comprising a first section extending angularly from said front edge of said top to a second section of said slit, said second section extending from said first section toward said back edge of said top, such that said second section is substantially perpendicular to said front edge, said first section and said second section of said slit extending angularly through said top, such that an upper limit of said slit is offset from a lower limit of said slit, said plurality of slits comprising from two to six said slits, said plurality of slits comprising four said slits;

a plurality of slots positioned in said top of said housing, said slots extending from said front edge of said top to proximate to said back edge of said top, wherein each said slot is configured for insertion of a handle of a toothbrush such that a head of the toothbrush is positioned above said top of said housing, said plurality of slots comprising from two to six said slots, said plurality of slots comprising four said slots;

each of said slits and said slots being substantially evenly spaced in said top, said plurality of slits and said plurality of slots being positioned in said top such that a pair of said slits are positioned adjacent to one said opposing side, a duo of said slots are positioned adjacent to the other said opposing side, and wherein two said slots and two said slits are alternately positioned between said pair of said slits and said duo of said slots;

each said slot comprising a plurality of cutouts, said cutouts being positioned through said top and extending from said slot, wherein each said cutout extends from said slot such that said cutout is configured for insertion of a toothbrush handle, said cutouts being substantially ovally shaped, each of said pluralities of cutouts comprising two cutouts, wherein each said slot is configured for insertion of two toothbrush handles;

a plurality of fasteners coupled to a back of said housing, said fasteners comprising double-sided tape, wherein a first side of said fastener is coupled to said back of said housing and a second side of said fastener is configured to couple to the medicine cabinet, said plurality of fasteners comprising fasteners positioned proximate to each corner of said back of said housing;

a plurality of pegs, each said peg being positioned on and coupled to a respective opposing side of said housing, said plurality of pegs comprising:

a plurality of dowels coupled to and extending substantially perpendicularly from a respective opposing side of said housing, said dowels being substantially circular when viewed perpendicularly from said respective said opposing side, said plurality of dowels comprising six said dowels positioned in two rows, said rows extending from proximate to said top to proximate to said bottom, and a plurality of couplers coupled to and extending transversely from a respective opposing side of said housing, said couplers being substantially rectangularly box shaped when viewed longitudinally, each said coupler being coupled by a first end to said respective said opposing side, said coupler having a second end positioned above said first end defining a catch comprising said coupler and said housing, said plurality of couplers comprising six said couplers positioned in two lines, said lines extending from proximate to said top to proximate to said bottom; and wherein said fasteners are positioned on said back of said housing such that said fasteners are configured to couple said housing to a medicine cabinet, wherein each said slit is configured for insertion of a bottom end of a tube such that the tube is retained in a cap down position substantially within said housing, wherein each said slot is configured for insertion of a toothbrush handle such that the toothbrush head is positioned above said top of said housing, and wherein said pegs are positioned on said opposing sides of said housing such that said pegs are configured for the user to hang items on said pegs.

* * * * *